US006273770B1

(12) United States Patent
Saito

(10) Patent No.: US 6,273,770 B1
(45) Date of Patent: Aug. 14, 2001

(54) HYDRAULIC TILT SYSTEM FOR MARINE PROPULSION

(75) Inventor: Hideki Saito, Kakegawa (JP)

(73) Assignee: Soqi Kabushiki Kaisha, Kakegawa (JP)

( * ) Notice: Subject to any disclaimer, the term of this patent is extended or adjusted under 35 U.S.C. 154(b) by 0 days.

(21) Appl. No.: 09/506,825

(22) Filed: Feb. 18, 2000

(30) Foreign Application Priority Data

Feb. 18, 1999 (JP) ..... 11-039899

(51) Int. Cl.[7] ..... B63H 5/125
(52) U.S. Cl. ..... 440/61
(58) Field of Search ..... 137/106; 60/460; 440/53, 61, 900

(56) References Cited

U.S. PATENT DOCUMENTS 4,064,824 * 12/1977 Hall et al. ..... 440/61
4,557,696 12/1985 Nakahama .
5,444,979 * 8/1995 Funami et al. ..... 440/61
5,718,613 2/1998 Nakamura .
6,015,318 1/2000 Uematsu et al. .
6,106,343 8/2000 Nakamura .

* cited by examiner

*Primary Examiner*—Ed Swinehart
(74) *Attorney, Agent, or Firm*—Knobbe, Martens, Olson & Bear, LLP

(57) ABSTRACT

A hydraulic tilt system for a marine propulsion includes an improved construction for ensuring a reliable tilting operation and holding the marine propulsion at a tilted position securely. The hydraulic tilt system has a pair of shuttle valve assemblies which can selectively deliver working fluid to one of upper and lower chambers in a tilt cylinder housing from a fluid pump or return it to the pump from the other chamber. The respective shuttle valve assemblies include shuttle pistons slidably supported in shuttle housings. Only one of the shuttle pistons has a seal member therearound. A small gap is, therefore, formed between an outer surface of the other shuttle piston and an inner surface of the shuttle housing. An air bubble or excessive fluid which may accumulate in a fluid passage connecting the both shuttle housings will promptly slip out through the gap

18 Claims, 5 Drawing Sheets

HYDRAULIC TILT SYSTEM FOR MARINE PROPULSION

BACKGROUND OF THE INVENTION

1. Field of the Invention

This invention relates to a hydraulic tilt system for a marine propulsion, and more particularly to an improved hydraulic tilt system that provides a reliable tilting and holding operations of the marine propulsion.

2. Description of Related Art

A drive unit of an outboard motor is typically mounted on a transom of an associated watercraft by means of a bracket assembly which comprises a swivel bracket and a clamping bracket. The swivel bracket supports the drive unit for pivotal movement about a generally vertically extending axis. The clamping bracket is affixed to the transom of the associated watercraft and supports the swivel bracket for pivotal movement about a generally horizontally extending axis.

Usually, a hydraulic cylinder assembly is interposed between the swivel and clamping brackets to tilt up or down the drive unit. The cylinder assembly comprises a cylinder housing, a tilt piston slidably supported within the cylinder housing and defining a couple of fluid chambers. A piston rod is affixed to the tilt piston and extends therefrom through one of the fluid chambers. The cylinder housing is affixed to one of the swivel bracket and clamping bracket, while an outer end of the piston rod is affixed to the reminder of the brackets. A pressurizing mechanism including, for example, a fluid pump pressurizes fluid in the fluid chambers for causing reciprocal movement of the tilt piston within the cylinder housing so that the drive unit is tilted up or down. The hydraulic cylinder assembly and the pressurizing mechanism generally define a hydraulic tilt system.

Although various arrangements are applicable for the hydraulic tilt system, a shuttle valve assembly is one typical component that is employed in these arrangements. The shuttle valve assembly includes a shuttle cylinder housing having openings at both outer ends and a shuttle piston slidably supported within the shuttle cylinder housing. The openings are joined with each one of the fluid chambers in the cylinder housing. A pair of closure valves are provided for closing the openings of the outer ends of the cylinder housing. The shuttle piston defines a pair of shuttle chambers in the housing and has projections provided at both sides to confront the closure valves. A reversible fluid pump, for example, is joined to the shuttle chambers with its inlet-outlet ports. When one of the shuttle chambers is pressurized by the fluid pump, the closure valve at this shuttle valve is pushed out to permit fluid flow through the opening to the fluid chamber in the cylinder housing for effecting the tilt piston moves. Simultaneously, the shuttle valve moves toward the other closure valve and pushes the valve outwardly by its projection. Accordingly, the fluid in the other fluid chamber may return to the other inlet-outlet port through the opening at this side of the shuttle cylinder not to resist the movement of the tilt piston. A typical shuttle valve assembly is disclosed in U.S. Pat. No. 4,557,696.

The shuttle valve assembly is advantageous because the hydraulic tilt system can be neatly formed. However, a space for the hydraulic tilt system, which is defined in the bracket assembly and specifically between the swivel bracket and clamping bracket, is extremely narrow. In order to place the shuttle valve assembly in this space, improved shuttle valve assemblies are desirable.

SUMMARY OF THE INVENTION

In accordance with one aspect of the present invention, a hydraulic tilt system for a watercraft and an outboard drive comprises a cylinder housing adapted to be affixed to one of the watercraft and the outboard drive. A tilt piston is slidably supported within the cylinder housing and defining a first chamber and a second chamber in the cylinder housing. A piston rod extends from the tilt piston through one of the first chamber and the second chamber for attachment to the other of the outboard drive and the watercraft. A pressurizing mechanism is arranged to selectively pressurize fluid within the first chamber and the second chamber for causing reciprocal movement of the tilt piston. The pressurizing mechanism has a pair of ports through which fluid is pushed out and received.

Shuttle housings are provided, one of which is positioned between the first chamber and one of the ports and the other one of which is positioned between the second chamber and the other one of the ports. Shuttle pistons are slidably supported within each one of the shuttle housings defining a third chamber and a fourth chamber in each one of the shuttle housings. The fourth chambers are connected to each other. Each of the shuttle pistons has a check valve arranged to permit fluid in the third chamber to flow to the fourth chamber and to preclude inverse flow of the fluid. The first chamber and the second chamber are each connected for fluid communication with one of the ports through the third chambers. A pair of shutting mechanisms are arranged to shut the communications. Each of the shutting mechanisms is rendered ineffective by pressurized fluid in the third chamber and is also rendered ineffective by the shuttle piston being moved toward the shutting mechanism by the pressurized fluid in the third chamber of the other shuttle housing. One of the shuttle pistons has a seal arranged to separate the third chamber from the fourth chamber. The other one of the shuttle pistons permits leakage from the fourth chamber to the third chamber, such as by providing no seal around the piston.

In accordance with another aspect of the present invention, a hydraulic tilt system for an outboard drive comprises a fluid motor including a lower chamber and an upper chamber. A powering device is arranged to selectively deliver pressurized fluid to the lower chamber and the upper chamber and receive the fluid from the lower chamber and the upper chamber. The powering device has a pair of ports for selectively delivering and receiving the fluid therethrough.

A first passage joins one of the ports and one of the lower chamber and the upper chamber. A second passage joins the other one of the ports and the other one of the lower chamber and the upper chamber. A first housing is disposed in the first passage and has a first actuator slidably movable within the first housing. The first actuator defines a first actuating chamber and a first pressurizing chamber. The first passage passes through the first actuating chamber. A first closure unit is arranged to primarily close the first passage and open the first passage when the first actuating chamber is pressurized. The first actuator has a projection that opens the first passage against the first closure unit when the first pressurizing chamber is pressurized. The first actuator has a check valve that permits flow of the fluid in the first actuating chamber to the first pressurizing chamber and precludes inverse flow.

A second housing is disposed in the second passage and has a second actuator slidably movable within the second housing. The second actuator defines second actuating chamber and a second pressurizing chamber. The second passage passes through the second actuating chamber. A second closure unit is arranged to primarily close the second passage and open the second passage when the second actuating chamber is pressurized. The second actuator has a projection that opens the second passage against the second closure unit when the second pressurizing chamber is pressurized. The second actuator has a check valve that permits flow of the fluid in the second actuating chamber to the second pressurizing chamber and precludes inverse flow.

A third passage joins the first pressurizing chamber to the second pressurizing chamber. An outer diameter of the first actuator is smaller than an inner diameter of the first actuator housing. An outer diameter of the second actuator is smaller than an inner diameter of the second actuator housing. A seal is provided only around one of the first actuator and the second actuator to prevent communication between the actuating chamber and the pressurizing chamber separated by the actuator having the seal.

Further aspects, features and advantages of this invention will become apparent from the detailed description of the preferred embodiments which follow.

DETAILED DESCRIPTION OF THE PREFERRED EMBODIMENTS OF THE INVENTION

With reference to FIGS. 1(A) to 1(C) and 2, there is schematically illustrated a split/type shuttle valve assembly that has some advantage but also a disadvantage. The assembly includes a shuttle cylinder housing 20 in which a pair of separate shuttle pistons 22A, 22B are slidably supported. Although the housing 20 is occasionally completely separated, the illustrated housing 20 is integrated and a pair of shuttle chambers 24A, 24B and a single communication passage 26 are defined by the shuttle pistons 22A, 22B in the housing 20. The housing 20 has a pair of openings 28A, 28B each connected to a shuttle chamber and an upper chamber of a tilt cylinder assembly. The openings 28A, 28B are primarily closed by check valves 30A, 30B, respectively, which are biased by springs 32A, 32B. The respective shuttle pistons 22A, 22B have projections 36A, 36B that are confronted with the check valves 30A, 30B, respectively, to push out the closure valves 30A, 30B from the openings 28A, 28B when the pistons 22A, 22B are pressurized from to behind. In order to pressurize the other shuttle pistons 22A, 22B from behind, the respective pistons 22A, 22B have check valves 40A, 40B that permit fluid in the shuttle chambers 24A, 24B flowing into the fluid passage 26 but preclude inverse flow of the fluid. The illustrated shuttle pistons 22A, 22B have annular seals 42A, 42B around them to entirely separate the shuttle chambers 24A, 24B from the fluid passage 26. A reversible fluid pump 44 is connected to the respective shuttle chambers 24A, 24B with its inlet-outlet ports 46A, 46B.

Figure 1A:
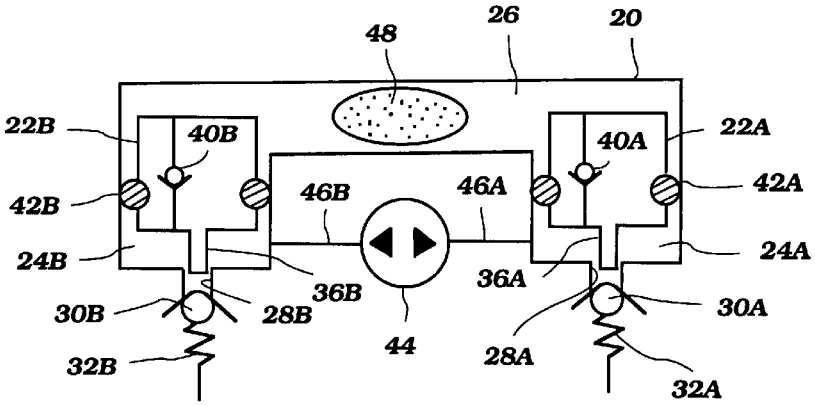
FIGS. 1(A) to 1(C) and 2 illustrate schematic views of a split type shuttle valve assembly under several conditions.

FIG. 1(A) shows a condition that the fluid pump 44 is not operated. Occasionally, an air bubble 48 is accumulated within the fluid passage 26 and this bubble may cause a problem.

Figure 1B:
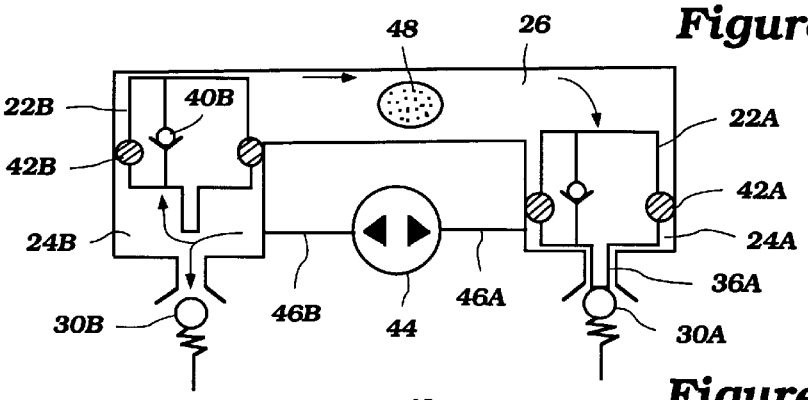

As seen in FIG. 1(B), when the fluid pump 44 is operated to pressurize, for example, the shuttle chamber 24B, the closure valve 30B is pushed out against the biasing force of the spring 32B. Simultaneously, although the shuttle piston 22B itself is pushed slightly backward, the fluid in the chamber 24B is sent to the fluid passage 26 through the check valve 40B to push the other shuffle piston 22A from behind. Since the check valve 40A will not open in this situation, the piston 22A pushes the closure valve 30A with its projection 36A against the biasing force of the spring 32A. Accordingly, a delivery passage from the pump 44 to the tilt cylinder and a return passage vise versa are ensured. Under this condition, the air bubble 48 is compressed to be smaller by the pressure.

Figure 1C:
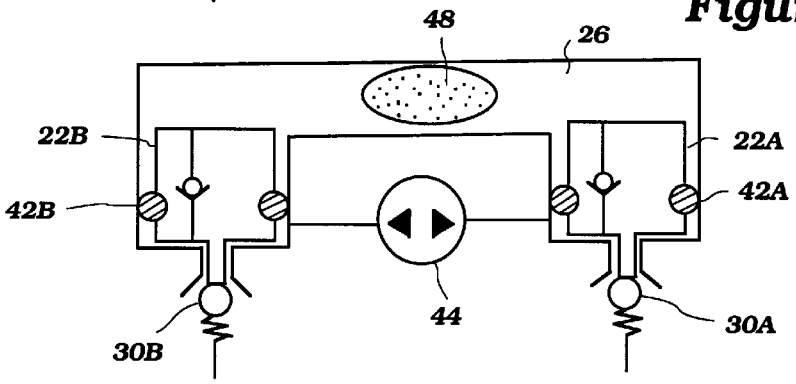

After the operation of the fluid pump 44, as seen in FIG. 1(C), the air bubble 48 again expands and conversely pressurizes the shuttle pistons 22A, 22B from behind. As a result, the both projections 36A, 36B continuously push the closure valves 30A, 30B and the delivery and return passages are maintained. Therefore, the drive unit of the outboard motor is lowered by its own weight contrary to the operator's intention.

Figure 2:
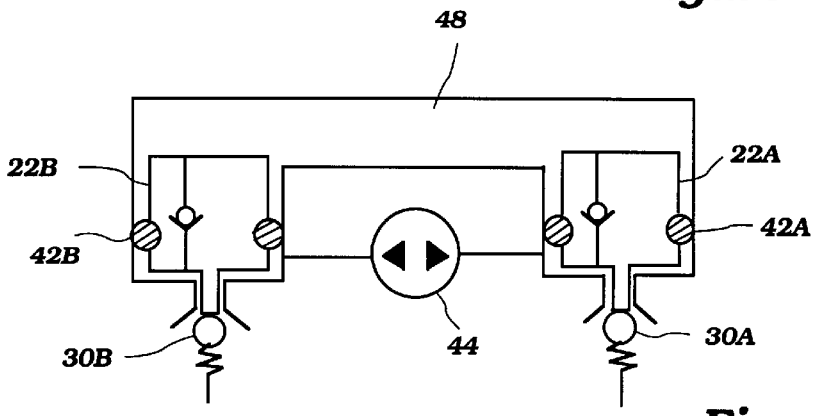

Otherwise, as seen in FIG. 2, with long term usage of the hydraulic tilt system, the fluid per se may accumulate little by little within the fluid passage 26. This accumulated fluid pressurizes the shuttle pistons 22A, 22B from behind also. This results, in the situation shown in FIG. 1(C), the open state of the delivery and return passages and hence the drive unit of the outboard motor is lowered and urged to stay at this position.

A need therefore exists for an improved hydraulic tilt system wherein a split type shuttle assembly can discharge such an air bubble or excessive fluid accumulated within a fluid chamber as soon as possible and the tilt system can provide a reliable tilting operation and holds the marine propulsion at a tilted position securely.

Figure 3:
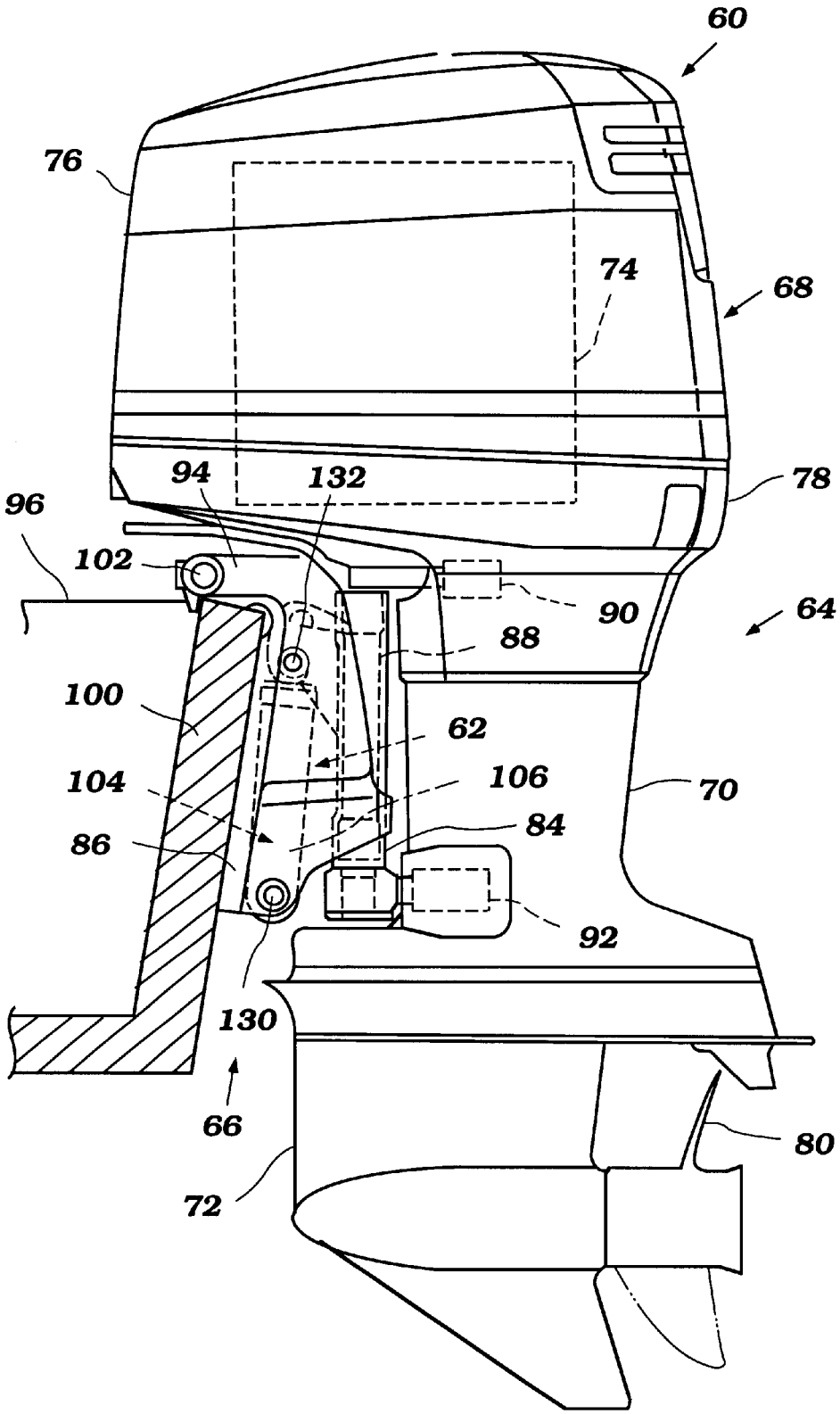
FIG. 3 is a side elevational view showing an outboard motor that employs a hydraulic tilt system in accordance with a preferred embodiment of the present invention. An associated watercraft is sectioned in part. A drive unit of the outboard motor is placed at a fully tilted down position.
Figure 4:
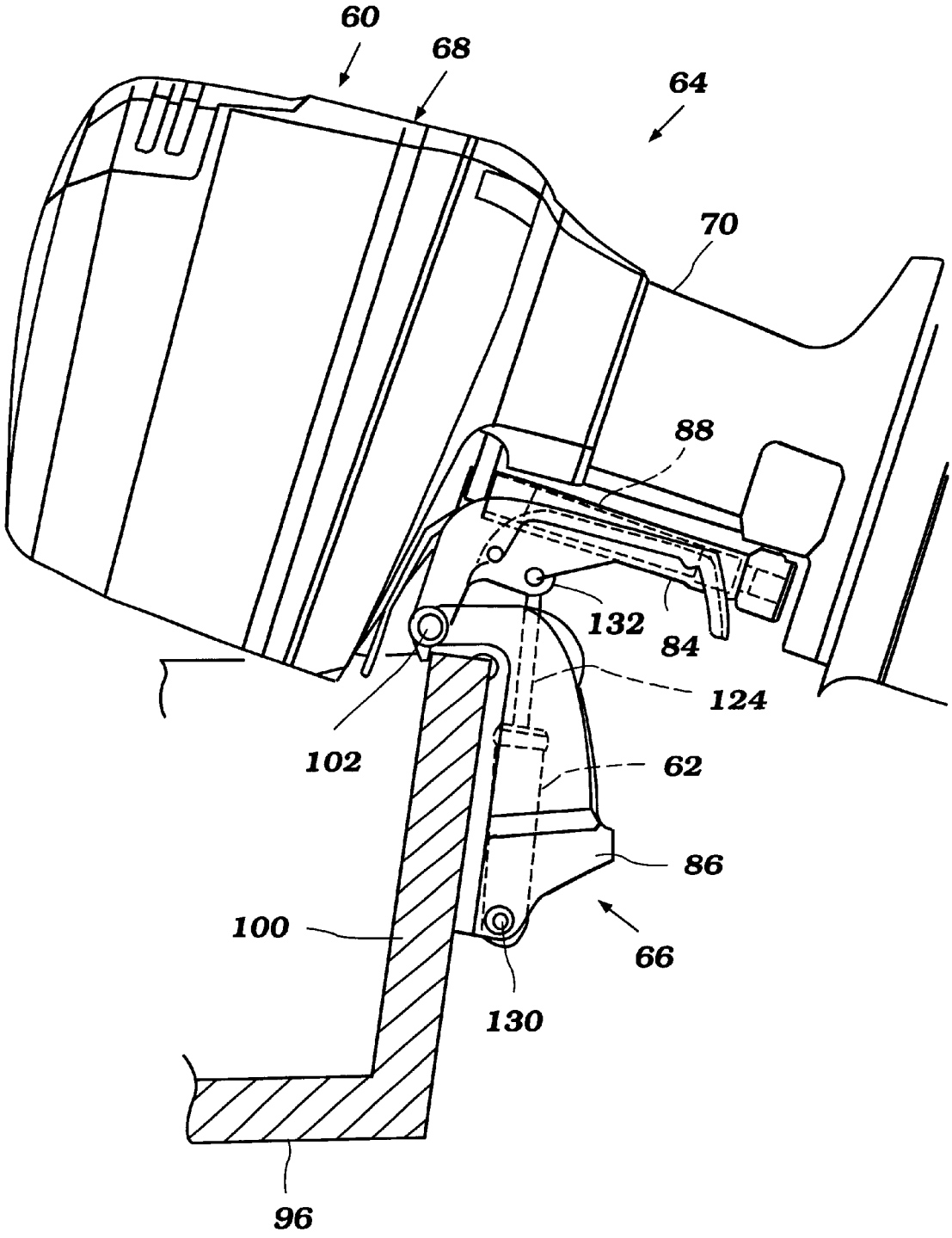
FIG. 4 is a side elevational view showing the same outboard motor. The drive unit is placed at a fully tilted up position.
Figure 5:
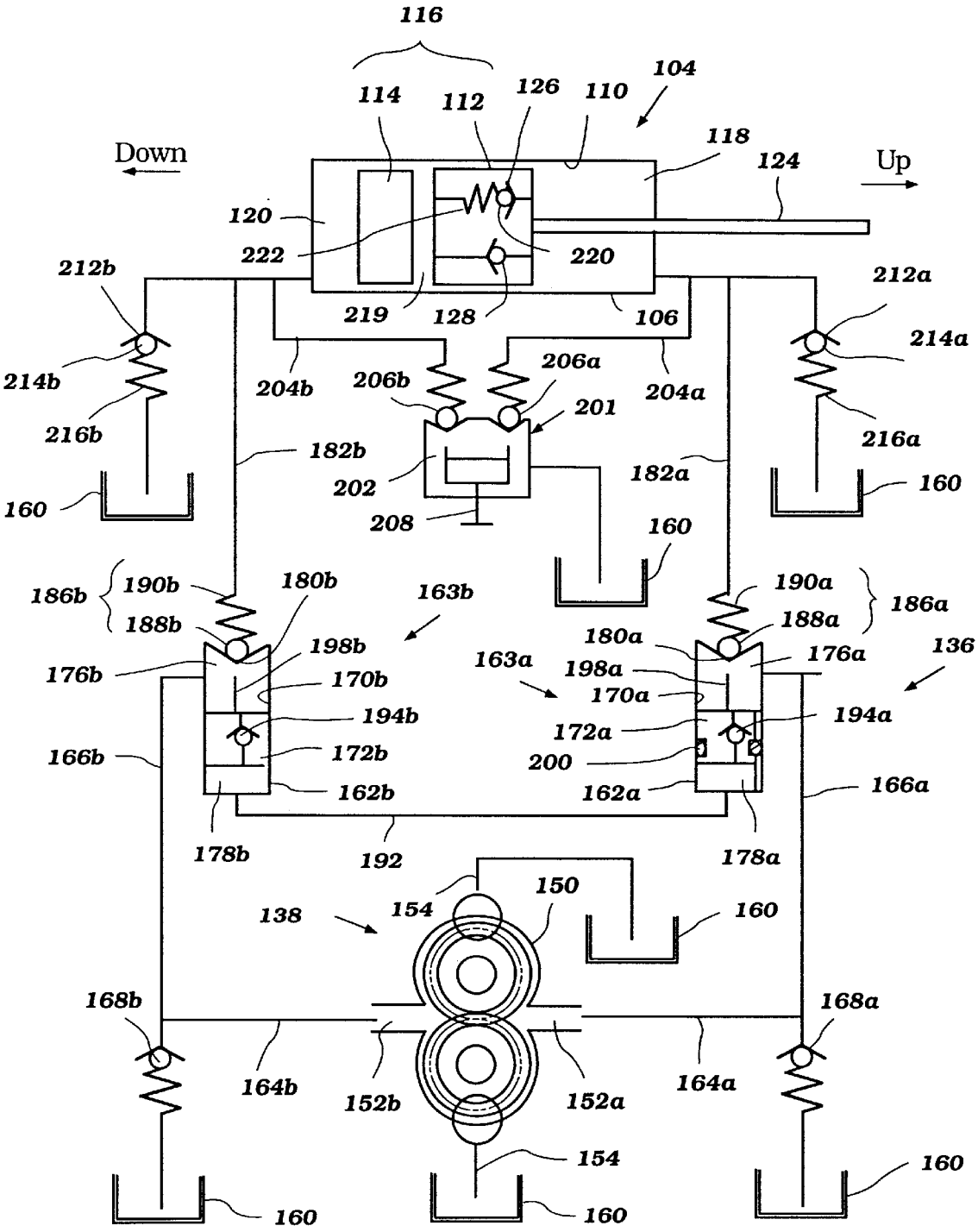
FIG. 5 is a schematic view showing a fluid circuit including a hydraulic tilt cylinder assembly, a split type shuttle valve assembly and a fluid motor employed in the hydraulic tilt system.

With reference to FIGS. 3 to 5, an arrangement illustrates resolves the bubble problem. An outboard motor, designated generally by reference numeral 60, includes a hydraulic tilt system 62. Although the present invention is shown in the context of an outboard motor, various aspects and features of the present invention also can be employed with other types of outboard drives (e.g., a stern drive unit).

In the illustrated embodiment, the outboard motor 60 comprises a drive unit 64 and a bracket assembly 66. The drive unit 64 includes a power head 68, a driveshaft housing 70 and a lower unit 72. The power head 68 is disposed atop of the drive unit 64 and includes an internal combustion engine 74, top protecting cowling 76 and bottom protecting cowling 78. The engine 74 powers a propulsion device of the outboard motor 60. Although not shown, the engine 74 has an output shaft or a crankshaft extending generally vertically. The top and bottom cowlings 76, 78 generally completely enclose the engine 44. The top cowling 76 is detachably affixed to the bottom cowling 78 to permit access to the engine 74 for maintenance or other purposes.

The driveshaft housing 70 depends from the power head 68 and supports a driveshaft which is driven by the output shaft of the engine. The driveshaft extends generally vertically through the driveshaft housing 70.

The lower unit 72 depends from the driveshaft housing 70 and supports a propeller shaft which is driven by the driveshaft. The propeller shaft extends generally horizontally through the lower unit 72. In the illustrated embodiment, the propulsion device includes a propeller 80 that is affixed to an outer end of the propeller shaft and is driven by the propeller shaft A bevel gear transmission couples together the two shafts which lie generally normal to each other (i.e., at a 90° shaft angle). The transmission has a switchover mechanism to shift rotational directions of the propeller 80 to forward, neutral or reverse.

The bracket assembly 66 comprises a swivel bracket 84 and a clamping bracket 86. The swivel bracket 84 supports the drive unit 64 for pivotal movement about a generally vertically extending axis, i.e., an axis of a steering shaft 88. The steering shaft 88 extends through a shaft housing of the swivel bracket 84, and the ends of the steering shaft 88 are affixed to the driveshaft housing 70 by an upper mount assembly 90 and a lower mount assembly 92. A steering section 94 extends slightly upwardly and then forwardly from the steering shaft 88 to be steered in a manner which is well known. For instance, a push-pull cable is provided between the steering section 94 and a steering wheel which is located in proximity to a control panel of an associated watercraft 96 to swing the steering section 94. The clamping bracket 86, in turn, is affixed to a transom 100 of the associated watercraft 96 and supports the swivel bracket 84 for pivotal movement about a generally horizontally extending axis, i.e., an axis of a tilt shaft 102.

As used through this description, the terms "front," "forward" and "forwardly" mean at or to the side where the clamping bracket 86 is positioned and the terms "reverse," "rear," and "rearwardly" mean at or to the opposite side of the front side, unless indicated otherwise.

The hydraulic tilt system 62 is provided between the swivel bracket 84 and the clamping bracket 86. The hydraulic tilt system 62 includes a hydraulic tilt cylinder assembly or fluid motor 104. Although various arrangements such as, for example, a telescopic tilt and trim arrangement are applicable, the illustrated cylinder assembly 104 has one of the simplest constructions for easy understanding.

As best seen in FIG. 5, the cylinder assembly 104 has a tilt cylinder housing 106 that defines an internal cavity 110. A tilt piston 112 is slidably supported in the cavity 110. A floating piston 114 is also provided in the cavity 110. The floating piston 114 usually moves with the tilt piston 112 as a unit except for a shock absorbing operation. Thus, the tilt piston 112 and floating piston 114 together define a tilt piston unit 116. Although both pistons 112, 114 actually have annular seals around them, such seals are not shown in FIG. 5. Generally, an upper chamber 118 and a lower chamber 120 are defined by the tilt piston unit 116 in the internal cavity 110 of the cylinder housing 106. A piston rod 124 is affixed to the tilt piston 112 and extends through the upper chamber 118 and beyond the cavity 110. The tilt piston 112 has a shock absorber valve 126 and a return valve 128 therein. Functions of these valves 126, 128 will be described later.

Returning to FIGS. 3 and 4, the lower end of the cylinder housing 106 is affixed to the clamping bracket 86 for pivotal movement about a generally horizontally extending axis, i.e., an axis of a pivotal shaft 130. The top end of the piston rod 124 is affixed to the swivel bracket 84 for pivotal movement about a generally horizontally extending axis, i.e., an axis of another pivotal shaft 132.

The hydraulic tilt system 62 further includes a pressurizing mechanism 136 (see FIG. 5) that is disposed within the bracket assembly 62 as well as the hydraulic tilt cylinder assembly 104. More specifically, it is located in a space which is formed between the swivel bracket 84 and clamping bracket 86 with the cylinder assembly 104. When the lower chamber 120 of the cylinder assembly 106 is pressurized by the pressurizing mechanism 136, the tilt piston unit 116 moves upwardly to tilt up the drive unit 64; when the upper chamber 118 of the cylinder assembly 106 is pressurized by the pressurizing mechanism 136, the tilt piston unit 116 moves downwardly to tilt down the drive unit 64. Thus, the drive unit 64 can be tilted up and down reciprocally within a range from a fully tilted down position shown in FIG. 3 to a fully tilted up position shown in FIG. 4 or vise versa.

The pressurizing mechanism 136 includes a powering assembly or device 138 that comprises a reversible electric motor (not shown) that drives a reversible fluid pump 150 in a forward or reverse direction. The pump 150 has a pair of inlet-outlet ports 152*a*, 152*b* which will be selectively an inlet port and an outlet port in response to the rotational directions of the fluid pump 150. When working fluid is pushed out from the port 152*a* (152*b*), it acts as the outlet port. Otherwise, when the fluid is received by or returns to the port 152*b* (152*a*), it acts as the inlet port.

In the illustrated embodiment, the fluid pump 150 further has a pair of suction ports 154 which are connected to a fluid reservoir 160. Although a plurality of fluid reservoirs are illustrated in FIG. 5, actually only one reservoir 160 is provided. The suction ports 154 are provided for supplementing deficiency of the fluid to the circuit from the reservoir 160. This fluid deficiency occurs when the tilt piston 124 moves out from the internal cavity 110 of the cylinder housing 106 because of the tilt piston 124 volume.

The inlet-outlet port 152*a* is connected to an up-shuttle housing or up-actuator housing 162*a* of a shuttle valve assembly 163*a* through fluid lines 164*a*, 166*a*, while the inlet-outlet port 152*b* is connected to a down-shuttle housing or down-actuator housing 162*b* of another shuttle valve assembly 163*b* through fluid lines 164*b*, 166*b*. The inlet-outlet ports 152*a*, 152*b* are also connected to an up-relief valve 168*a* and a down-relief valve 168*b*, respectively, at respective conjunctions of the lines 164*a*, 166*b* and lines 164*b*, 166*b*. The housings 162*a*, 162*b* have internal cavities 170*a*, 170*b*, respectively. Shuttle pistons or actuators 172*a*, 172*b* are slidably supported in the respective cavities 170*a*, 170*b* and define shuttle chambers 176*a*, 176*b* and pressurring chambers 178*a*, 178*b* therein. Openings 180*a*, 180*b* are formed at sides of the housings 162*a*, 162*b* that extend generally transversely relative to an axis along which the tilt pistons 172*a*, 172*b* reciprocally move and outer ends of internal cavities 170*a*, 170*b*. Fluid lines 182*a*, 182*b* are connected to these openings 180*a*, 180*b* so as to be joined with the fluid lines 166*a*, 166*b* through the openings 180*a*, 180*b* and shuttle chambers 176*a*, 176*b*. The fluid lines 166*a*, 166*b* are actually connected to other sides of the housings 162*a*, 162*b*, said lines extending generally parallel to the aforenoted axis of the shuttle pistons 172*a*, 172*b*. The fluid line 182*a* is connected to the upper chamber 118 of the tilt cylinder housing 106, while the fluid line 182*b* is connected to the lower chamber 120 thereof.

Shutting mechanisms or closure units 186*a*, 186*b* are provided to shut communications between the passages 166*a*, 182*a* and communications between the passages 166*b*, 168*b*. In other words, the openings 180*a*, 180*b* are closed by these units 186*a*, 186*b*. The closure units 186*a*, 186*b* include ball valves 188*a*, 188*b* and biasing springs 190*a*, 190*b* that bias the ball valves 188*a*, 188*b* toward their closing positions.

The pressurizing chambers 178*a*, 178*b* are joined by a fluid line 192. In order to deliver fluid to this fluid line 192 so as to pressurize the other shuttle pistons 172*b*, 172*a* from behind, the respective shuttle pistons 172*a*, 172*b* have check valves 194*a*, 194*b* that permit the fluid in the shuttle chambers 176*a*, 176*b* to flow into the pressurizing chambers 178*a*, 178*b* and preclude the inverse flow of the fluid. The shuttle pistons 172*a*, 172*b* further have projections 198*a*, 198*b* that protrude into the shuttle chambers 176*a*, 176*b* and confront the ball valves 188*a*, 188*b*. Thus, when the pressurizing chambers 178*a*, 178*b* receive fluid from the other shuttle chambers 178*a*, 178*b*, the shuttle pistons 172*a*, 172*b* are pressurized and their projections 198*a*, 198*b* push the ball valves 188*a*, 188*b* outwardly against the biasing force of the springs 190*a*, 190*b* to ensure the communications between the passages 166*a*, 182*a* and the communications between the passages 166*b*, 182*b*.

Both of the shuttle pistons 172*a*, 172*b* may have seals. In the illustrated embodiment, however, only the shuttle piston 172*a* has a seal 200 that is arranged to separate the shuttle chamber 176*a* from the pressurizing chamber 178*a*. More specifically, the annular seal 200 is mounted around the shuttle piston 172*a* to seal a space between the body of the piston 172*a* and an inner surface of the housing 162*a*. Since the other shuttle piston 172*b* has no seal member, a space is formed or remains between the body of the piston 172*b* and an inner surface of the housing 162*b*. This space is very narrow because an outer diameter of the piston 172*b* is only slightly smaller than an inner diameter of the housing 162*b*. The space, therefore, primarily precludes fluid from flowing therethrough but permits slow fluid flow.

In the illustrated embodiment, the hydraulic tilt system 62 includes a manual valve assembly 201 between the upper chamber 118 and the lower chamber 120 of the cylinder housing 106. The manual valve assembly 201 comprises a common chamber 202 that communicates with both of the upper and lower chambers 118, 120 through respective fluid lines 204*a*, 204*b*. Closure valves 206*a*, 206*b* are provided to primarily shut the communications between the common chamber 202 and the upper chamber 118 and the lower chamber 120. The manual valve assembly 201 includes an actuator 208 that can be actuated by the operator. When the operator actuates the actuator 208, the closure valves are pushed away and the aforenoted communications are ensured and the upper and lower chambers 118, 120 are joined to each other. Under this condition, the operator can manually tilt up and down the drive unit 64. The fluid reservoir 160 is connected to the common chamber 202 so as to adjust the fluid amount in the upper and lower chambers 118, 120.

In the illustrated embodiment, the hydraulic tilt system 62 further includes a pair of thermal protect valves or temperature relief valves 212*a*, 212*b*. The thermal protect valve 212*a* is disposed between the upper chamber 118 of the tilt cylinder housing 106 and the fluid reservoir 160, while the other thermal protect valve 212*b* is disposed between the lower chamber 120 of the tilt cylinder housing 106 and also the fluid reservoir 160. These valves 212*a*, 212*b* have balls or valve elements 214*a*, 214*b* which primarily shut the communication between the chambers 118, 120 and the reservoir 160 by the biasing force of springs 216*a*, 216*b* but allow fluid in these chambers 118, 120 flowing into the reservoir 160 when fluid pressure in the chambers 118, 120 exceeds a predetermined value due to expansion of fluid therein under high temperature.

As noted above, the tilt piston 112 has the shock absorber valve 126 and return valve 128 therein. These valves 126, 128 are provided for allowing the drive unit 64 to pop up in the event an underwater obstacle is struck and then return to its initial position. This operation is achieved in cooperation with the floating piston 114. The shock absorber valve 126 is disposed in an absorber valve passage that joins the upper chamber 118 to a space 219 defined between the tilt piston 112 and floating piston 114. The shock absorber valve 126 has a ball or valve element 220 that is biased by a spring 222 to close the absorber valve passage. If extremely large pressure is produced in the upper chamber 118, i.e., sufficient force is applied, the absorber valve 126 is opened against the biasing force of the spring 222 to allow the fluid in the upper chamber 118 flowing to the space. The inverse flow from the space 219 to the upper chamber 118 is precluded by the absorber valve 126. The return valve 128, disposed in a return valve passage that also joins the upper chamber 118 to the space 219, allows fluid in the space 219 to return to the upper chamber 118. The return valve 128 includes a ball or check valve element which is not biased by a spring but does not permit the fluid in the upper chamber 118 flow to the space 219 anyhow.

Because of such an arrangement, the shock absorber valve 126 permits restricted flow of the fluid from the upper chamber 118 to the space 219 so as to permit the drive unit 64 to pop up when an underwater obstacle is struck and if sufficient force is applied to open the shock absorber valve 126. Under this condition, although the tilt piston 112 moves upwardly, the floating piston 114 will remain at an initial position because the fluid in the space 219 between the both pistons 112, 114 has no way to flow out and also the fluid in the lower chamber 120 still stay there. When the underwater obstacle is cleared, the drive unit 64 may return to the initial position because the fluid in the space 219 returns to the upper chamber 118 through the return valve 128.

With primarily reference to FIG. 5, main operations of the hydraulic tilt system 62, particularly operations of the shuttle valve assemblies 163*a*, 163*b*, will now be described.

When the fluid pump 150 is rotated in one of the directions to push fluid out to the inlet-outlet port 152*b*, the fluid is delivered to the shuttle chamber 176*b* in the down-shuttle housing 162*b* through the fluid lines 164*b*, 166*b*. to pressurize this chamber 176*b*. The closure unit 186*b* is therefore pushed away by this pressure and the communication between the fluid lines 166*b*, 182*b* is ensured and the fluid is further transferred to the lower chamber 120 of the tilt cylinder housing 106. At the same moment, the fluid in the shuttle chamber 176*b* flows into the pressurizing chamber 178*b* through the check valve 194*b*, which does not prevent flow in this direction, and then goes to the pressurizing chamber 178*a* of the upper shuttle housing 162*a* through the fluid line 192. Since the check valve 194*a* in the shuttle piston 172*a* prevents flow in this direction and also the seal 200 securely shuts the communication of the fluid between the pressurizing chamber 178*a* and shuttle chamber 176*a*, pressure is generated in the pressurizing chamber 178*a* that pushes the shuttle piston 172*a* from behind toward the closure unit 186*a*. The projection 198*a* of the piston 172*a*, accordingly, removes the ball valve 188*a* away from the opening 180*a* and hence the communication of the fluid between the fluid lines 166*a*, 182*a* is also ensured. As a result, the fluid in the upper chamber 118 of the tilt cylinder housing 106 is now allowed to return to the fluid pump 150 through the fluid line 182*a*, shuttle chamber 176*a*, fluid lines 166*a*, 164*a* and inlet-outlet port 152*a*. The fluid delivered to the lower chamber 120 of the cylinder housing 106 moves the tilt piston unit 116 upwardly. This movement of the tilt piston unit 116 tilts up the drive unit 64 because the piston rod 124 tilts up the swivel bracket 88.

The reverse operation of the fluid pump 150 makes the tilt piston unit 116 move downwardly in a similar manner and the drive unit 64 is then tilted down. However, an operation of the shuttle piston 172*b* is slightly different from that of the shuttle piston 172*a*.

The fluid transferred to the pressurizing chamber 178*b* is primarily precluded from flowing into the shuttle chamber 194*b* by the check valve 194*b* and also the shuttle piston 172*b*. However, because of the slight space formed between the body of the piston 172*b* and the inner surface of the housing 162*b* that is not provided with any seal, the fluid may seep into the shuttle chamber 176*b* through that slight space. However, this amount of the fluid is quite small because the shuttle piston 172*b* per se may provide a certain measure of the sealing function and the tilt down operation is not affected inasmuch as the closure unit 186*b* can be pushed away from the opening 180*b*. This means that, in another facet, the fluid accumulated in the fluid passage 192 or the pressurizing chambers 178*a*, 178*b* can leak slowly to the shuttle chamber 176*b*. This construction is also effective when an air bubble is trapped within the fluid passage 192. The air bubble may sneak through the space to the shuttle chamber 176*b* in a certain time period.

No seal on the piston 172*b* is needed because the drive unit 64 will move down by its own weight. If the seal were to be provided on the shuttle piston 172*b* and not on the shuttle piston 172*a*, under the tilt up operation, the fluid within the passage 192 and the pressurizing chamber 178*a* would leak to the shuttle chamber 176*a* in the up-shuttle housing 162*a* through the space formed between the piston 172*a* and the housing 162*a* even the check valve 194*a* would prevent flow of the fluid in this direction. This leaked fluid then would return to the pump 150 through the fluid lines 166*a*, 164*a* Accordingly, it could be difficult to tilt up the drive unit 64 against its own weight. However, as noted above, in the illustrated embodiment, the shuttle piston that has no seal member is the piston 172*b* and not the piston 172*a*. Though the fluid may leak to the shuttle chamber 176*b* from the fluid passage 192, this does not affect the tilt down movement.

Figure 6:
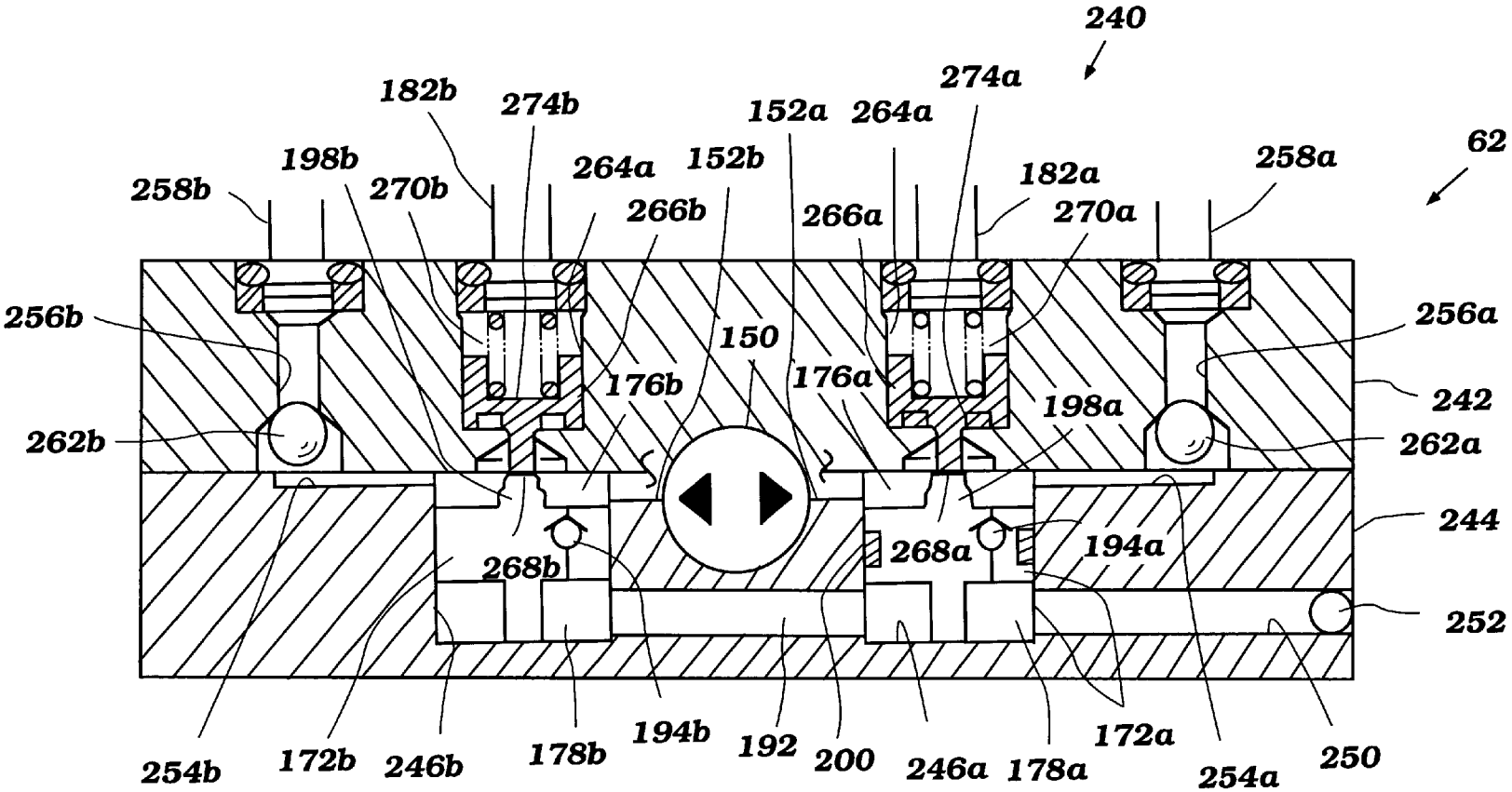
FIG. 6 is a schematic view showing another fluid circuit in accordance with a second embodiment of the present invention. A hydraulic tilt cylinder assembly is omitted in this figure.

With reference to FIG. 6, another arrangement of the hydraulic tilt system 62 in accordance with a second embodiment of the present invention will now be described. The same members and components that are already described with the first embodiment shown in FIGS. 3 to 5 are assigned with the same reference numerals and will not be described repeatedly. In this figure, the tilt cylinder assembly 104, fluid reservoir 160 and insignificant components such as the relief valves 168*a*, 168*b* are not illustrated.

A shuttle valve assembly 240 in this arrangement is constructed within an upper member 242 and a lower member 244. The lower member 242 has a pair of shuttle cavities 246*a*, 246*b*. The shuttle pistons 172*a*, 172*b* are disposed in these cavities 246*a*, 246*b*, respectively, so as to be movable along axes extending generally vertically and define the shuttle chambers 176*a*, 176*b* and pressurizing chambers 178*a*, 178*b* in the shuttle cavities 246*a*, 246*b*. Therefore, the lower member 244 forms a shuttle housing in this illustrated embodiment. The shuttle pistons 172*a*, 172*b* have the check valves 194*a*, 194*b* which are set in the same way as the first embodiment shown in FIG. 5. Also, like the first embodiment, only the shuttle valve 172*a* has the annular seal 200. An opening 250 is bored transversely in the lower member 244 from its side to the cavity 246*b* through the cavity 246*a*. A portion of the opening 250 that exists between the cavities 246*a*, 246*b* define the fluid passage 192 that communicates with the pressurizing chambers 178*a*, 178*b*. The outer end of the opening is closed by a closure 252.

Although actually the fluid pump 150 is provided apart from these upper and lower members 242, 244, it is schematically illustrated within these members 242, 244. The inlet-outlet ports 152*a*, 152*b* are connected to the shuttle chambers 176*a*, 176*b*, respectively. The fluid pump 150 illustrated in this embodiment has no suction ports. However, the inlet-outlet ports 152*a*, 152*b* are connected to a fluid reservoir (not shown in this figure) through the shuttle chambers 176*a*, 176*b*, horizontal fluid passages 254*a*, 254*b*, vertical fluid passages 256*a*, 256*b* which are formed within the members 242, 244 and outer fluid passages 258*a*, 258*b*. The horizontal fluid passages 254*a*, 254*b* are formed with grooves on the lower member 244 and a lower surface of the upper member 242. The vertical fluid passages 256*a*, 256*b* are formed with openings that are bored vertically in the upper member 242. Balls or check valves 262*a*, 262*b* are provided at bottoms of vertical passages 256*a*, 256*b* and on valve seats. These check valves 262*a*, 262*b* permit fluid to flow from the reservoir to the pump 150 but prevent inverse flow. These constructions, therefore, provide the same functions of the suction ports 154 in the first embodiment.

Two other vertical openings 264*a*, 264*b* are provided in the upper member 242 to join the shuttle chambers 176*a*, 176*b* of the cavities 246*a*, 246*b* in the lower member 244 with the outer fluid passages that correspond to the fluid lines 182*a*, 182*b* in FIG. 5. Although not shown, the outer fluid passages 182*a* and 182*b* are connected to the upper chamber 118 and the lower chamber 120 of the tilt cylinder housing 106 shown in FIG. 5. The bottom portions of these vertical openings 264*a*, 264*b* are once narrowed and then widened toward the cavities 246*a*, 246*b*. Valves 266*a*, 266*b*, which correspond to the balls valves 188*a*, 188*b* in FIG. 5, are slidably provided in the respective vertical openings 264*a*, 264*b*. The valves 266*a*, 266*b* are made slightly smaller than the openings 264*a*, 264*b* to permit fluid flowing between outer surfaces of the valves 266*a*, 266*b* and inner surfaces of the openings 264*a*, 264*b*. The valves 266*a*, 266*b* have projections 268*a*, 268*b* that pass through the narrowed portions of the vertical openings 264*a*, 264*b*. Outer diameters of the projections 268*a*, 268*b* are slightly smaller than inner diameters of the narrowed portions. The valves 266*a*, 266*b* are biased downwardly by springs 270*a*, 270*b*, which are seated within recesses formed at the valves 266*a*, 266*b*, to have the projections 268*a*, 268*b* contact the projections 198*a*, 198*b* of the shuttle pistons 172*a*, 172*b*. Annular seals 274*a*, 274*b* are attached respectively to the valves 266*a*, 266*b* to completely shut communications between the cavities 246*a*, 246*b* in the lower member 244 and the outer fluid lines 182*a*, 182*b*.

When the fluid pump 150 is rotated in one of the directions, for example, to push fluid out to the inlet-outlet port 152*b*, the fluid is delivered to the shuttle chamber 176*b* to develop pressure in this chamber 176*b* that pushes up the valve 266*b* and makes the communication between the chamber 176*b* and the outer fluid line 182*b* through the vertical opening 264*b*. At the same moment, the fluid in the shuttle chamber 176*b* flows into the pressurizing chamber 178*b* through the check valve 194*b*, which does not prevent flow in this direction, and further to the other pressurizing chamber 178*a* through the fluid passage 192. Since the check valve 194*a* in the shuttle piston 172*a*, in turn, prevents flow in this direction and also the seal 200 securely shuts the communication of the fluid between the pressurizing chamber 178*a* and shuttle chamber 176*a*, pressure is generated in the pressurizing chamber 178*a* that pushes the shuttle piston 172*a* from behind toward the projection 268*a* of the rectangular valve 266*a*. The projection 198*a* of the piston 172*a*, accordingly, pushes the projection 268*a* of the valve 188*a* and hence the communication of the fluid between the shuttle chamber 176*a* and the outer fluid line 182*a* is also ensured. As a result, the fluid in the upper chamber 118 (see FIG. 5) of the tilt cylinder housing 106 is now allowed to return to the fluid pump 150 through the fluid line 182*a*, vertical opening 264*a*, shuttle chamber 176*a* and inlet-outlet port 152*a* Thus, referring to FIG. 5, the fluid delivered to the lower chamber 120 of the cylinder housing 106 moves the tilt piston unit 116 upwardly. This movement of the tilt piston unit 116 tilts up the drive unit 64 because the piston rod 124 tilts up the swivel bracket 88.

The reverse operation of the fluid pump 150 causes the tilt piston unit 116 to move downwardly in a similar manner and the drive unit 64 is then tilted down. The operation of the shuttle piston 172*b* is slightly different from that of the shuttle piston 172*a*. However, this operation is the same as that described with the first embodiment. Therefore, it will not be repeated again.

Although the hydraulic tilt cylinder assembly 104 in both of the first and second embodiments has one of the simplest structures, a conventional cylinder assembly which has more complicated structure may be employed instead of the present tilt assembly 104. For instance, a telescopic tilt and trim cylinder assembly such as disclosed in U.S. Pat. No. 5,718,613 is applicable.

In the illustrated embodiments, the cylinder housing 106 is connected with the clamping bracket 86, while the piston rod 124 is connected with the swivel bracket 84. However, the inverse connections are of course available. In the inverse connections, the aforenoted upper chamber 118 should be read as the lower chamber and the lower chamber 120 should be read as the upper chamber.

As described above, one of shuttle pistons has a surrounding seal, while the other shuttle piston has no seal and hence may form a very small gap between an outer surface of the shuttle piston and an inner surface of a shuttle housing. In the event an air bubble accumulates at a fluid passage that connects two shuttle housings, the bubble can leak through the gap. Also, because of the gap, excessive fluid will never stay in the fluid passage. Since both shuttle valve assemblies will not open unless a fluid pump is activated accordingly, a hydraulic tilt system can provide a secure tilting operation and holds the marine propulsion at a tilted position securely.

Of course, the foregoing description is that of preferred embodiments of the invention, and various changes and modifications may be made without departing from the spirit and scope of the invention, as defined by the appended claims. For example, the significance of the lack of a seal between a piston and a surrounding cylinder is that fluid leakage will occur between the two elements. Thus other arrangements for permitting slow leakage are available.

What is claimed is:

1. A hydraulic system for operating between a watercraft and an outboard drive comprising a cylinder housing adapted to be affixed to one of the watercraft and the outboard drive, a piston slidably supported within the cylinder housing so as to define a first variable-volume chamber and a second variable-volume chamber in the cylinder housing on opposite sides of the piston, a piston rod extending from the piston through one of the first and second chambers for attachment to the other one of the outboard drive and the watercraft, a pressurizing mechanism arranged to selectively pressurize fluid within one of the first and second chambers for causing reciprocal movement of the piston within the cylinder housing, the pressurizing mechanism having a pair of ports through which fluid is pushed out and received, at least two of shuttle bores one of the shuttle bores being positioned between the first chamber and one of the ports and the other one of the shuttle bores being positioned between the second chamber and the other one of the ports, shuttle pistons each one being slidably supported within one of the shuttle bores so as to define a third variable-volume chamber and a fourth variable-volume chamber in the respective shuttle bore on opposite sides of the shuttle piston, the fourth chambers being connected to each other, each one of the shuttle pistons having a check valve arranged to permit fluid in the third chamber to flow to the fourth chamber and to generally preclude a reverse flow of the fluid, the first chamber and the second chamber each being connected with a respective one of the ports through a respective one of the third chambers, a pair of shutting mechanisms one shutting mechanism being arranged to shut off communication between the first chamber and the respective third chamber and the other shutting mechanism being arranged to shut off communication between the second chamber and the respective third chamber, each one of the shutting mechanisms being rendered ineffective by pressurized fluid in the respective third chamber and by the shuttle piston which is moved toward the shutting mechanism by the pressurized fluid in the respective fourth chamber, one of the shuttle pistons having a seal arranged to separate the respective third chamber from the fourth chamber, and the other shuttle piston permitting slow leakage of fluid between the respective third chamber and fourth chamber.

2. A hydraulic system as set forth in claim 1, wherein a space is formed between said other shuttle piston and an inner surface of the associated shuttle bore and the space permits the fluid to flow slowly between the respective third and fourth chambers.

3. A hydraulic system as set forth in claim 1, wherein a space is formed between said other shuttle piston and an inner surface of the associated shuttle bore, the space permits an air bubble existing in the fourth chambers to flow therethrough toward the third chamber by relatively slow degrees.

4. A hydraulic system as set forth in claim 1, wherein each one of the shutting mechanisms includes an opening into the shuttle bore, and a closure member arranged to close the opening.

5. A hydraulic system as set forth in claim 4, wherein the closure members are biased by biasing members.

6. A hydraulic system as set forth in claim 4, wherein each one of the shuttle pistons has a projection that is capable to pass through the associated opening, and each one of the projections selectively pushes the associated closure member to allow each one of the third chambers to communicate with the first chamber or the second chamber when the shuttle piston moves in result of pressurization of the fourth chamber.

7. A hydraulic system as set forth in claim 1, wherein the first chamber defines a lower chamber and the second chamber defines an upper chamber, and the shuttle piston, which is supported in the shuttle bore that is positioned between the upper chamber and the pressurizing mechanism, has the seal.

8. A hydraulic system as set forth in claim 1, wherein the pressurizing mechanism includes a reversible fluid pump.

9. A hydraulic system as set forth in claim 1, wherein a diameter of each shuttle piston is smaller than a diameter of an inner surface of the associated shuttle bore so as to define a space between the bore and the shuttle piston, and the seal is provided in the space and tightly contacts with both the shuttle piston and the inner surface of the shuttle bore.

10. A hydraulic system as set forth in claim 9, wherein the space that has no seal permits air existing in the fourth chambers to flow through the space toward the third chamber.

11. A hydraulic system as set forth in claim 1, wherein each one of the shutting mechanisms is disposed in a recess defined in a first housing member, the recess communicates with the first chamber or the second chamber, the recess further communicates with one of the third chambers through an orifice, each one of the shutting mechanisms includes a valve body slideably disposed within the recess, the valve body has a projection extending through the orifice and contacting with each one of the shuttle pistons, a biasing member urging the valve body toward a bottom of the recess, and a second seal affixed to each one of the valve bodies at a portion facing the third chamber so as to stop communication between the recess and the third chamber when the valve body is urged into a closed position by the biasing member.

12. A hydraulic system as set forth in claim 11, wherein the shuttle bores are defined in a second housing member which is affixed to the first housing member in which the recesses are disposed.

13. A hydraulic system as set forth in claim 12 wherein the shuttle bores extend into the second housing member from a side of the second housing member, and the first and second housing members are joined together with said side of the second housing member being contiguous with the first housing member.

14. A hydraulic system for an outboard drive comprising a fluid motor including a lower chamber and an upper chamber, a powering device arranged to selectively deliver pressurized fluid to the lower chamber and the upper chamber and to receive the fluid from the lower chamber and the upper chamber, the powering device having a pair of ports for selectively delivering and receiving the fluid therethrough, a first passage joining one of the ports and one of the lower chamber and the upper chamber, a second passage joining the other one of the ports and the other one of the lower chamber and the upper chamber, a first bore disposed in the first passage and having a first actuator slidably movable within the first bore, the first actuator defining a first actuating chamber and a first pressurizing chamber, the first passage passing through the first actuating chamber, a first closure unit arranged to primarily close the first passage and open the first passage when the first actuating chamber is pressurized, the first actuator having a projection that opens the first passage against the first closure unit when the first pressurizing chamber is pressurized, the first actuator having a check valve that permits flow of the fluid in the first actuating chamber to the first pressurizing chamber and precludes reverse flow, a second bore disposed in the second passage and having a second actuator slidably movable within the second bore, the second actuator defining a second actuating chamber and a second pressurizing chamber, the second passage passing through the second actuating chamber, a second closure unit arranged to primarily close the second passage and open the second passage when the second actuating chamber is pressurized, the second actuator having a projection that opens the second passage against the second closure unit when the second pressurizing chamber is pressurized, the second actuator having another check valve that permits flow of the fluid in the second actuating chamber to the second pressurizing chamber and precludes reverse flow, a third passage joining the first pressurizing chamber to the second pressurizing chamber, an outer diameter of the first actuator being smaller than an inner diameter of the first actuator bore, an outer diameter of the second actuator being smaller than an inner diameter of the second actuator bore, and a seal being provided only around one of the first actuator and the second actuator to prevent communication between the actuating chamber and the pressurizing chamber separated by the actuator having the seal.

15. A hydraulic system as set forth in claim 14, wherein a space is formed between the first actuator and an inner surface of the first actuator bore, and the space permits the fluid to flow therethrough by relatively slow degrees.

16. A hydraulic system as set forth in claim 14, wherein a space is formed between the first actuator and an inner surface of the actuator bore, the space being of a sufficient size to permit an air bubble trapped within the third passage to flow through the space toward the first actuator chamber.

17. A hydraulic system as set forth in claim 14, wherein a seal is provided only around the second actuator to prevent communication between the second actuating chamber and the second pressurizing chamber.

18. A hydraulic system as set forth in claim 14, wherein the powering device includes a reversible fluid pump.

* * * * *